US006938884B2

(12) United States Patent
Knaus et al.

(10) Patent No.: US 6,938,884 B2
(45) Date of Patent: Sep. 6, 2005

(54) CARBURETOR ARRANGEMENT OF A PORTABLE HANDHELD WORK APPARATUS

(75) Inventors: Konrad Knaus, Gaildorf (DE); Andreas Hägele, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/937,363

(22) Filed: Sep. 10, 2004

(65) Prior Publication Data

US 2005/0051912 A1 Mar. 10, 2005

(30) Foreign Application Priority Data

Sep. 10, 2003 (DE) ..... 103 41 600

(51) Int. Cl.[7] ..... F02M 7/08
(52) U.S. Cl. ..... 261/34.2; 261/35
(58) Field of Search ..... 261/34.2, 35, DIG. 8, 261/DIG. 49

(56) References Cited

U.S. PATENT DOCUMENTS 1,949,031 A * 2/1934 Weber ..... 261/34.2
1,981,483 A * 11/1934 Weber ..... 261/34.2
2,635,863 A * 4/1953 Olson ..... 261/34.2
2,785,880 A * 3/1957 Olson ..... 261/34.2
3,362,694 A * 1/1968 Gould ..... 261/23.2
5,250,233 A * 10/1993 Swanson ..... 261/34.2
6,293,524 B1 * 9/2001 Endo et al. ..... 261/34.2
6,595,500 B2 * 7/2003 Osburg et al. ..... 261/34.2
6,676,114 B2 * 1/2004 Gerhardy ..... 261/34.2
2002/0158349 A1 * 10/2002 Osburg et al. ..... 261/34.2

FOREIGN PATENT DOCUMENTS

JP 5-164001 * 6/1993 ..... 261/34.2

* cited by examiner

*Primary Examiner*—Richard L. Chiesa
(74) *Attorney, Agent, or Firm*—Walter Ottesen

(57) ABSTRACT

The invention relates to a carburetor arrangement of a portable handheld work apparatus and includes a carburetor (1), an accelerator pump (2) and a venting pump (3). The venting pump (3) acts on the accelerator pump (2) via a venting line (4). A check valve (5) is mounted in the venting line (4) in such a manner that its outlet end (6) is directed in the direction of the venting pump (3). A pretensioning device (7) is provided which holds a valve body (8) of the check valve (5) closed below a selected difference pressure between the outflow end (6) and an opposite-lying inflow end (9). A support device (10) which acts on the valve body (8) and is actuable, at one end, by pressure at the outflow end (6) without considering pressure at the other end (9) or by pressure on the inflow end (9) without considering the pressure on the other end (6).

9 Claims, 2 Drawing Sheets

CARBURETOR ARRANGEMENT OF A PORTABLE HANDHELD WORK APPARATUS

CROSS REFERENCE TO RELATED APPLICATION

This application claims priority of German patent application no. 103 41 600.5, filed Sep. 10, 2003, the entire content of which is incorporated herein by reference.

BACKGROUND OF THE INVENTION

Portable handheld work apparatus such as motor-driven chain saws, brushcutters, suction/blower apparatus or the like have an internal combustion engine as a drive motor. These apparatus have a carburetor arrangement for supplying the engine with an air/fuel mixture. The carburetor arrangement must ensure a good starting performance and also a good acceleration performance of the engine.

An adequately rich air/fuel mixture is required during a sudden acceleration operation. This air/fuel mixture cannot reliably be adjusted exclusively via the suction forces acting on the fuel nozzle in the intake channel. So-called accelerator pumps are known for making available additional fuel quantities when pulling on the throttle. These accelerator pumps are coupled, for example, to the position of the throttle flap. Accelerator pumps of this kind include a piston which pumps an additional quantity of fuel into the intake channel of the carburetor when opening the throttle flap. The internal combustion engine can then be cleanly run up with the short-term enriched air/fuel mixture.

After longer standstill times of the work apparatus, air or fuel vapor bubbles can form in the fuel system and especially in the fuel conducting parts of the carburetor. To avoid the starting difficulties associated therewith, carburetor arrangements are provided with venting pumps by means of which fuel including possibly collected air bubbles can be pumped out of the carburetor and back into the fuel tank so long until the fuel-conducting parts of the carburetor are filled free of bubbles with after-flowing fuel. Venting pumps of this kind are also characterized as purgers.

A flow-conducting connection between the venting pump and the accelerator pump via a venting line is also provided for a complete venting of the carburetor. In the venting line, a check valve is mounted which opens toward the purger. A further check valve is provided downstream of the venting pump. The venting pump includes, for example, an elastic pump bellows. By pressing the pump bellows, the fuel is moved from the interior of the pump bellows through the outflow-end check valve to the tank. Thereafter, the pump bellows returns to its original form because of the elastic material characteristics thereof. Fuel is drawn by suction through the inlet end check valve in the venting line by the accelerator pump.

A fuel pressure builds up in the accelerator pump when there is a sudden actuation of the throttle which pressure is provided for moving fuel into the intake channel. Via the flow-conducting connection of the accelerator pump to the venting pump, a portion of the discharged fuel can flow off through the venting line and the venting pump. The corresponding component portion is then not present for the formation of the mixture. A check valve located between the accelerator pump and the venting pump, which is adequately pretensioned in the closing direction to avoid this effect, can lead to the condition that the pump forces become unwantedly high during the venting operation. The elastic return formability of the pump bellows can then not be adequate.

It has been shown that the spring force in the check valve can lead to the situation that the valve remains closed with a slight injection pressure from the accelerator pump; whereas, for a very sudden depression of the throttle causing a high injection pressure, the check valve opens. The result is that a non-predictable undefined fuel quantity becomes lost through the venting line in the direction of the tank. A matching of the carburetor arrangement to the acceleration operation is difficult.

SUMMARY OF THE INVENTION

It is an object of the invention to provide a carburetor arrangement of the kind described above which is so improved that a reliable acceleration performance is given over a wider operating range with a good effectiveness of the venting pump.

The carburetor arrangement of the invention is for a portable handheld work apparatus. The carburetor arrangement includes: a carburetor; an accelerator pump; a venting line connected to the accelerator pump; a venting pump acting on the accelerator pump via the venting line; a check valve having an inflow end and an outflow end lying opposite the inflow end and wherein there is a difference pressure between the outflow end and the inflow end; the check valve being mounted in the venting line with the outflow end facing in a direction toward the venting pump; the check valve including a valve body movable between a first position whereat the check valve is closed and a second position whereat the check valve is open; pretensioning means for holding the valve body in the first position when the difference pressure lies below a preselected value thereof; and, support means for operating on the valve body and being actuable on one side thereof by pressure at the outflow end without considering the pressure at the inflow end or by pressure at the inflow end without considering pressure at the outflow end.

A carburetor arrangement is suggested wherein pretensioning means are provided which hold a valve body of the check valve closed below a selected difference pressure. This selected difference pressure acts between the outflow end and an opposite-lying inflow end. Support means are provided which act on the valve body and which are actuable by the pressure either on the outflow end or on the inflow end without considering the pressure on the corresponding other end. Accordingly, for example, a closing force can be adjusted via the pretensioning means in such a manner that a slight suction force by the venting pump is adequate to open the check valve. Only slight pump forces are needed. The support means are actuable on one end via the pressure on the inflow end and operate on the valve body in such a manner that the closing force is increased with increasing inflow end pressure. For a corresponding adjustment, the closing force can be adjusted so high while considering the supporting means that even for a sudden actuation of the throttle and for the associated high fuel pressure from the accelerator pump associated therewith, the check valve remains closed. The entire fuel quantity, which is provided for the acceleration operation, can arrive at the carburetor from the accelerator pump.

In an advantageous further embodiment, the supporting means are so configured that they are actuable by the one-sided pressure on the outflow end of the check valve. In this arrangement, the closing force of the pretensioning means is selected to be so high that the check valve remains closed even for a sudden actuation of the throttle and the high difference pressure in the fuel arising therefrom between both ends of the check valve. When actuating the venting pump, an underpressure arises only at the outflow end of the check valve. This underpressure acts via the support means in a supporting manner on the valve body. In a corresponding embodiment, slight suction forces of the accelerator pump can be adequate to open the check valve. A reliable venting can be achieved with a low pump work and with a pump bellows of high elasticity and low return forces.

In an advantageous embodiment, the support means include a drive in the form of a membrane. One side of the membrane is charged with the pressure in the venting line and the other side of the membrane is charged with the ambient pressure. High supporting forces can be made available with low constructive complexity via the comparatively large-area membrane. High differences between the closing forces during an acceleration operation and the opening force during the pump operation can be achieved. A further increase of this difference can be achieved in a simple manner via an arrangement of a lever. The membrane operates on the valve body via this lever. The lever can be used, as required, for redirecting the membrane movement into a suitable movement of the valve body. By selecting the lever geometry, the force, which is needed for opening or closing the valve, can be precisely adapted.

The valve body is configured as an axially displaceable pin having a conically-shaped valve head for engaging in an annularly-shaped seal seat. The conically-shaped valve body is self centering in the annularly-shaped seal seat and leads to a good sealing action with slight contact forces. As required, the arrangement can be so designed that high forces for opening the valve are required in a wanted manner. The axially displaceable configuration of the pin leads to a good and reproducible guidance of the valve body.

In a further embodiment, the carburetor has a main outlet nozzle in its intake channel. A fuel channel for drawing in fuel by suction opens into the main outlet nozzle as does a pressure line parallel thereto from the accelerator pump. The fuel channel has a check valve. In this way, and with simple means, it is ensured that fuel, pumped by the accelerator pump, is not pumped through the fuel channel back in the direction of the tank or control chamber. The entire pumped quantity of the accelerator pump is guided through the main outlet nozzle into the intake channel. For a connection of the venting pump, for example, also to the control chamber of the membrane carburetor, an induction of air through the fuel channel is reliably avoided during the venting operation.

The fuel channel is advantageously subdivided into a main path and a flow conducting partially fixed nozzle path connected in parallel to the main path. Check valves are mounted in the main path and partially fixed nozzle path, respectively. Overall, the fuel system is thereby sealed in such a manner that a venting operation can be carried out by means of the venting pump without induction of air. On the other hand, the entire fuel quantity can be moved by the accelerator pump through the main outlet nozzle into the intake channel of the carburetor without back flow losses. A reliable runup of the engine is ensured.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
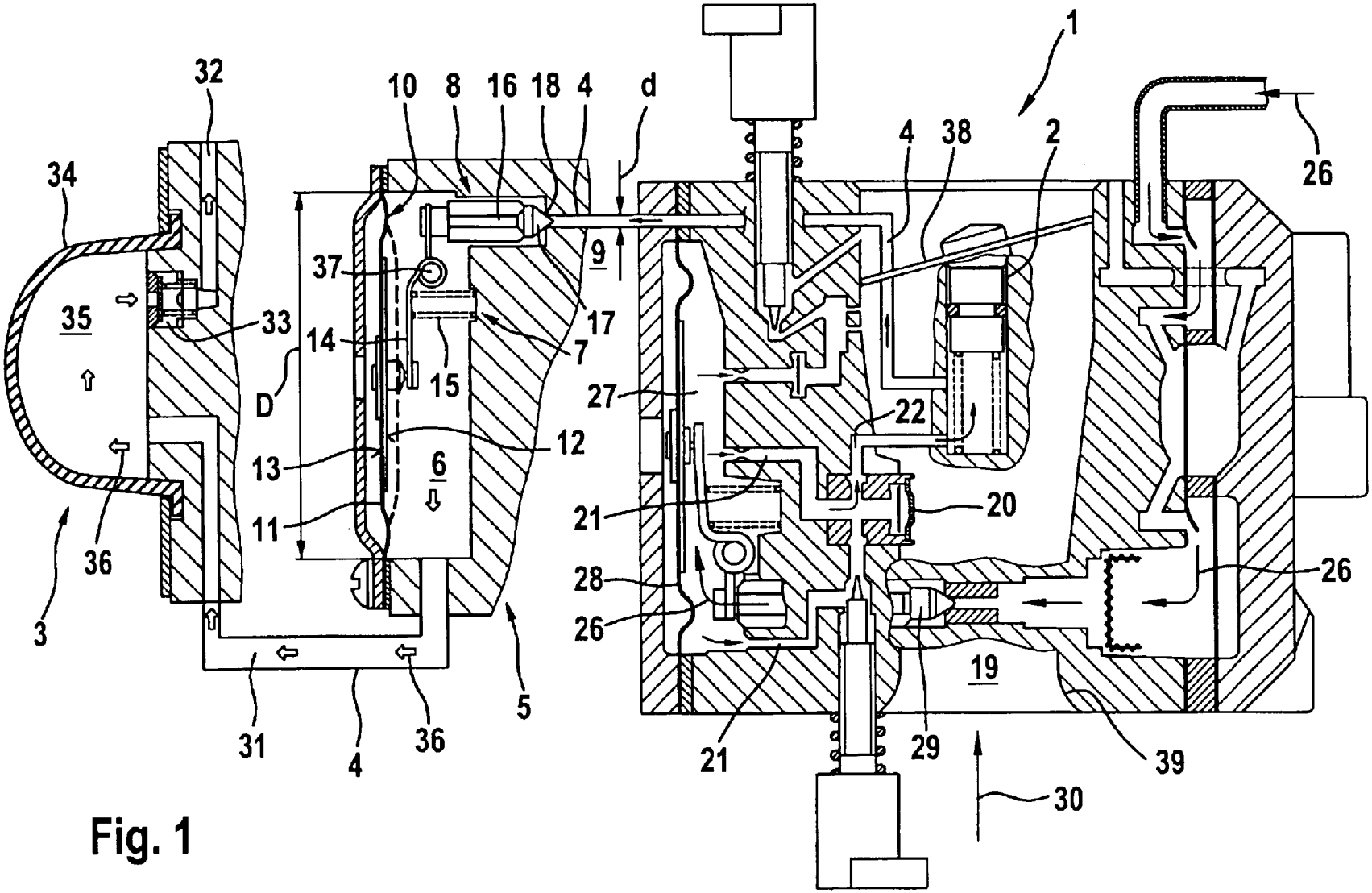
FIG. 1 is a schematic section view of the essential components of a membrane carburetor, a venting pump having a membrane supported check valve and an accelerator pump.

FIG. 1 shows a schematic section view of a carburetor 1 for an internal combustion engine (not shown) of a portable handheld work apparatus. The carburetor 1 includes an intake channel 19 through which there is a flow in the direction of arrow 30 during operation of the engine. The flow cross section of the intake channel 19 is adjustable by means of a pivotable throttle flap 38 for preselecting a desired power.

An underpressure forms in a narrowed venturi section 39 when there is a flow through the intake channel 19. Fuel is drawn through a main outlet nozzle 20 because of this underpressure and, with the air flow 30, an air/fuel mixture is prepared for supplying the engine.

The fuel is drawn by suction in the direction of arrows 26 from a tank (not shown). A control chamber 27 is provided which is delimited by a control membrane 28. Depending upon the pressure in the control chamber 27 and the deflection of the control membrane 28 associated therewith, a valve 29 can be actuated by means of which the throughflow of fuel can be controlled in the direction of arrows 26 through the control chamber 27 and the fuel channel 21 to the main outlet nozzle 20.

The carburetor shown includes an accelerator pump 2 which is coupled to the throttle flap 38. With the opening of the throttle flap 38, which is shown closed, a piston of the accelerator pump 2 presses fuel through a pressure line 22 to the main outlet nozzle 20 and, from there, into the intake channel 19. The interior space of the accelerator pump 2 is pressure-conductingly and flow-conductingly connected to a venting pump 3 via a venting line 4.

The venting pump 3 is also characterized as a purger. In the embodiment shown, the venting pump 3 includes an elastic pump bellows 34 which delimits a pump interior space 35. The venting line 4 opens into the pump interior space. A check valve 5 is mounted in the venting line 4 between the venting pump 3 and the accelerator pump 2. An outflow end 6 of the check valve 5 is mounted so as to face the venting pump 3; whereas, an inflow end 9 of the check valve 5 faces toward the accelerator pump 2. From this, there results a throughflow direction of the check valve 5 in the direction of arrow 36.

The venting pump 3 includes a pressure line 32 which leads in the direction of the tank (not shown). A check valve 33 is mounted in the pressure line 32. The volume of the pump interior space 35 decreases when the pump bellows 34 is pressed. Because of the developing pressure, the check valve 33 opens and the check valve 5 closes. Fuel and possibly vapor or air bubbles are pumped out of the pump interior space 35 in the direction of the arrows 36 through the pressure line 32 to the tank.

With a subsequent release of the pump bellows 34, the pump bellows relaxes automatically back into its original shape shown in the drawing. The elastic reset forces generate an underpressure in the pump interior space. By means of this underpressure, the check valve 33 in the pressure line 32 closes and the check valve 5 opens in the throughflow direction indicated by the arrows 36. The part of the venting line 4, which lies between the venting pump 3 and the check valve 5, thereby forms a suction line 31. Fuel and possibly air or vapor bubbles are, in this way, drawn by suction through the venting line 4 from the interior space of the accelerator pump 2 as well as from the remaining fuel-conducting spaces of the carburetor 1.

In the embodiment shown, the check valve 5 includes a valve body 8 in the form of an axially displaceable pin 16. The pin 16 includes a conically-shaped valve head 17 which engages in an annularly-shaped seal seat 18. The pretension force of a helical pressure spring 15 operates on the pin 16 by means of a lever 14 pivotable about a pivot axis 37. The helical pressure spring 15 thereby forms pretension means 7. The pretension means 7 holds the valve body 8 of the check valve 5 closed on the seal seat 18 beneath a pregiven difference pressure between the outflow end 6 and the inflow end 9.

A comparatively high pressure is required at the inflow end 9 because of the comparatively small diameter (d) of the venting line 4 in the region of the valve seat 18 in order to open the valve body 8 against the pressure of the pretensioning means 7. With the selection of the spring force of the pretensioning means 7 and, possibly, via geometric adaptation of the lever 14, the difference pressure, which is required for opening, can be set so high that the injection pressure, which is generated by the accelerator pump 2, in the venting line 4 is not sufficient at the inflow end 9 of the valve body 8 for opening. It is ensured that the fuel, which is moved by the accelerator pump 2, arrives completely in the intake channel 19 via the main outlet nozzle 20 without losses because of the venting line 4.

At the outflow end 6 of the valve body 8, supporting means 10 are arranged which, in the embodiment shown, include a membrane 11 and the lever 14. The membrane 11 acts via the lever 14 on the valve body 8. On a side 12, the membrane 11 is charged with the pressure in the venting line 4 and, on its opposite lying side, the membrane 11 is charged with the ambient pressure. The difference pressure, which is applied to the membrane 11, is therefore dependent upon the pressure of the outflow end 6 but independent of the pressure on the inflow end 9. An underpressure develops by means of the venting pump 3 because of the pump operation. With this underpressure in the intake line 31, the occurring pressure difference (between the outflow end 6 and the inflow end 9) operates in the opening direction on the valve body 8 without, however, having to overcome the pretensioning force of the helical pressure spring 15. The pressure difference between the outflow end 6 and the ambient air operates on the large-area membrane 11 in a supporting manner so that a deflection takes place in the direction of the position indicated in phantom outline in FIG. 1. Referred to the line diameter (d), the membrane 11 has a very large diameter D and therefore a large total area. Only very slight difference pressures at the membrane 11, which are generated by the venting pump 3, are sufficient in order to overcome the pretensioning force of the helical pressure spring 15 and bring about an opening of the check valve 5, that is, the valve body 8.

Figure 2:
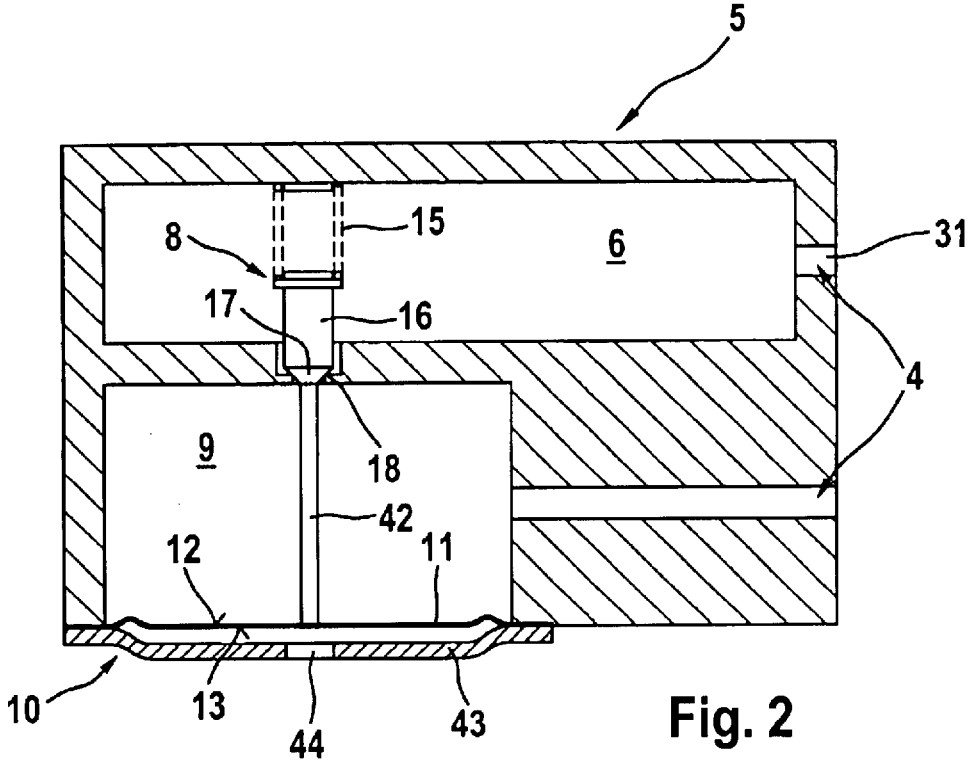
FIG. 2 is a schematic of a variation of the membrane-supported check valve of FIG. 1 having a membrane mounted at the inflow end; and, FIG. 3 is a schematic block diagram of a carburetor having a main outlet nozzle, an accelerator pump and check valves in the fuel channels.

FIG. 2 shows a further alternate embodiment of the check valve 5 of FIG. 1. In the check valve 5 shown in FIG. 2, the supporting means 10 are arranged at the inflow end 9 of the valve body 8. The supporting means 10 include a membrane 11 which acts on the pin 16 by means of a pull rod 42. One side 12 of the membrane 11 is charged with the pressure in the venting line 4 at the inflow end 9. The membrane 11 is covered by a cover 43 at its opposite-lying side 13. The cover 43 has a center hole 44. The outer-lying side of the membrane 11 is charged with ambient pressure via the hole 44. A pressure difference between the pressure at the inflow end 9 and the ambient pressure lies on the membrane 11 without considering the pressure of the outflow end 6.

A difference pressure between the inflow end 9 and the outflow end 6 lies on the valve body 8. With an underpressure in the intake line 31, which is generated by the venting pump 3 (FIG. 1), this pressure difference acts on the valve body 8 against the pretensioning force of the helical pressure spring 15 in the opening direction. The pretensioning force of the helical pressure spring 15 is selected so small that the pressure difference on the valve body 8 is sufficient for opening.

In a pump operation of the accelerator pump 2 (FIG. 1), an overpressure arises at the inflow end 9 and therefore a difference pressure between the inflow end 9 and the outflow end 6 which acts in the opening direction on the valve body 8. Additionally, a pressure difference arises between the inflow end 9 and the ambient pressure which deflects the membrane 11 in the direction of the cover 43. This deflection acts via the pull rod 42 on the valve body 8 in the closing direction. The closing force of the membrane 11 is greater than the opening force on the valve body 8 because of the larger diameter D of the membrane (FIG. 1). At high pressures on the inlet end 9, the check valve 5 is also held closed. No component quantity of the fuel can travel through the venting line 4 in the direction of the venting pump 3 during an injection operation by means of the accelerator pump 2.

In lieu of the check valve 5 with a pin 16 as shown in FIGS. 1 and 2, a check valve 5 can be provided whose valve body 8 is configured as a sphere valve, mushroom valve, membrane valve or the like. In lieu of the membrane 11, also a piston or the like can be practical. The pretensioning means 7 can be formed also by a spiral spring or other elastic bodies.

Figure 3:
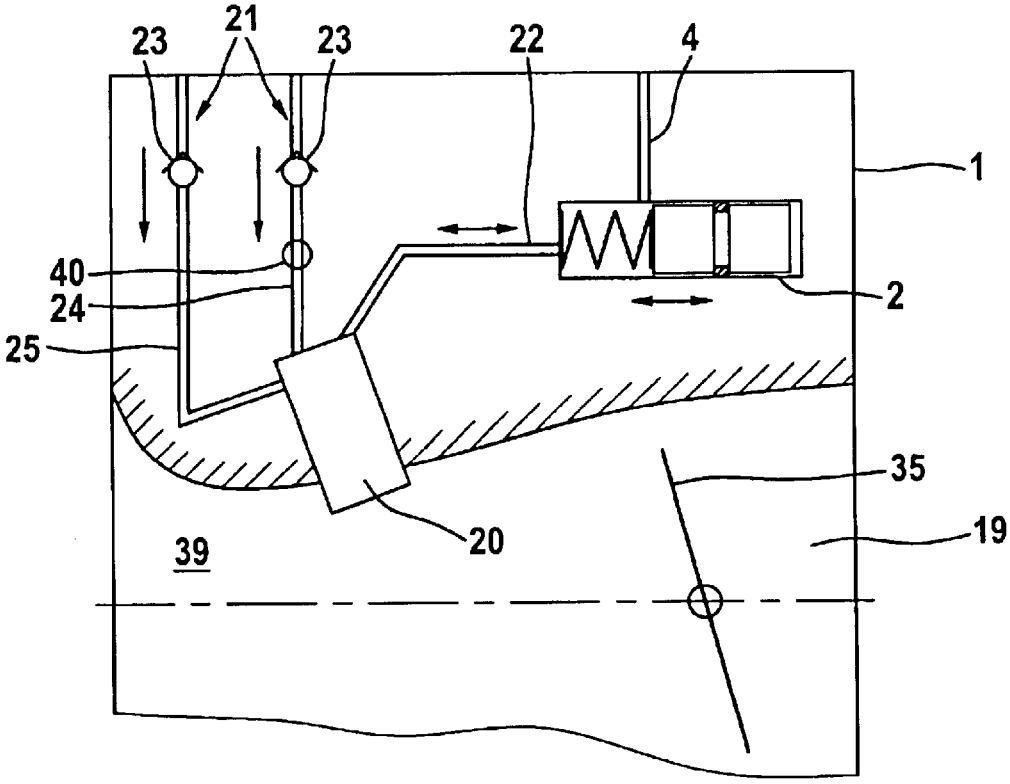

FIG. 3 shows a schematic block diagram of a carburetor 1 having an integrated accelerator pump 2. In the intake channel 19 of the carburetor 1, the main outlet nozzle 20 is mounted in the region of the venturi section 39 lying upstream of the throttle flap 35. A fuel channel 21 opens into the main outlet nozzle 20. In the embodiment shown, this fuel channel is subdivided into a main path 24 and a flow conducting nozzle path 25 connected in parallel therewith. Fuel from the control chamber 27 (FIG. 1) is drawn by suction via the fuel channel 21. In addition, a pressure line 22, which comes from the accelerator pump 2, opens into the main outlet nozzle 20. The nozzle path 25 is fixedly set with respect to the through-flowing fuel quantity. An additional fuel quantity, which can be conducted through the main path 24, is adjustable by means of a nozzle needle indicated by reference numeral 40.

In the main path 24 and in the nozzle path 25, respective check valves 23 are mounted in such a manner that the outflow end of the check valve 23 in each case is in a direction toward the main outlet nozzle 20. Because of an underpressure which develops in the venturi section 39, fuel can be drawn by suction through the main outlet nozzle 20 and, from there, through the main path 24 and the nozzle path 25.

With the actuation of the throttle flap 35, fuel is injected by means of the accelerator pump 2 via the pressure line 22 through the main outlet nozzle 20 into the intake channel 19. The check valves 23 close because of the pressure developing in the main outlet nozzle. The complete fuel quantity, which is moved by the accelerator pump 2, reaches the intake channel 19 via the main outlet nozzle 20 without component quantities of fuel being lost via the fuel channel 21.

It is understood that the foregoing description is that of the preferred embodiments of the invention and that various changes and modifications may be made thereto without departing from the spirit and scope of the invention as defined in the appended claims.

What is claimed is:

1. A carburetor arrangement for a portable handheld work apparatus, the carburetor arrangement comprising:

a carburetor;

an accelerator pump;

a venting line connected to said accelerator pump;

a venting pump acting on said accelerator pump via said venting line;

a check valve having an inflow end and an outflow end lying opposite said inflow end and wherein there is a difference pressure between said outflow end and said inflow end;

said check valve being mounted in said venting line with said outflow end facing in a direction toward said venting pump;

said check valve including a valve body movable between a first position whereat said check valve is closed and a second position whereat said check valve is open;

pretensioning means for holding said valve body in said first position when said difference pressure lies below a preselected value thereof; and, supporting means for operating on said valve body and being actuable on one side thereof by pressure at said outflow end without considering the pressure at said inflow end or by pressure at said inflow end without considering pressure at said outflow end.

2. The carburetor arrangement of claim 1, wherein said supporting means are actuable by a one-ended pressure on said outflow end of said check valve.

3. The carburetor arrangement of claim 1, wherein said supporting means includes a drive in the form of a membrane having a first side subjected to ambient pressure and a second side subjected to the pressure in said venting line.

4. The carburetor arrangement of claim 3, wherein said supporting means includes a lever for operatively connecting said membrane to said valve body so as to permit said membrane to act on said valve body.

5. The carburetor arrangement of claim 4, wherein said pretensioning means includes a helical pressure spring for acting on said valve body via said lever.

6. The carburetor arrangement of claim 1, wherein said check valve includes an annularly-shaped seal seat; and, said valve body is configured as an axially displaceable pin having a valve head for engaging said seal seat when said valve body is in said first position.

7. The carburetor arrangement of claim 6, wherein said valve head has a conical configuration.

8. The carburetor arrangement of claim 1, said carburetor including an intake channel and a main outlet nozzle arranged in said intake channel; said carburetor including a fuel channel opening into said main outlet nozzle and a check valve arranged in said fuel channel; and, a pressure line connected to said accelerator pump and being parallel to said fuel channel and opening into said main outlet nozzle.

9. The carburetor arrangement of claim 1, said carburetor including an intake channel and a main outlet nozzle arranged in said intake channel; said carburetor including a fuel channel opening into said main outlet nozzle; and, a pressure line connected to said accelerator pump and being parallel to said fuel channel and opening into said main outlet nozzle; said fuel channel being subdivided into a main path and a flow-conducting nozzle path connected in parallel thereto; and, said main path and said nozzle path having respective check valves arranged therein.

* * * * *